US005897965A

United States Patent [19]

Itoh et al.

[11] Patent Number: 5,897,965

[45] **Date of Patent: *Apr. 27, 1999**

[54] ELECTROLESSLY PLATED NICKEL/ PHOSPHORUS/BORON SYSTEM COATINGS AND MACHINE PARTS UTILIZING THE COATINGS

[75] Inventors: Hideya Itoh; Shizuo Toyoda; Tadao Senba, all of Tokyo; Takao Hasegawa, Saitama; Toshihiro Murayama, Saitama; Tomoyasu Takahashi, Saitama; Kazutaka Fujii, Saitama, all of Japan

[73] Assignees: Zexel Corporation; Japan Kanigen Co., Ltd., both of Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/564,735

[22] Filed: Nov. 29, 1995

[30] Foreign Application Priority Data

Nov. 29, 1994 [JP] Japan ..... 6-294459

[51] Int. Cl.[6] ..... B32B 15/00; B32B 15/20

[52] U.S. Cl. ..... 428/652; 428/680; 428/936

[58] Field of Search ..... 428/652, 680, 428/679, 936; 415/232

[56] References Cited

U.S. PATENT DOCUMENTS

| | | | |
|---|---|---|---|
| Re. 29,285 | 6/1977 | Christini et al. | 428/426 |
| 5,584,428 | 12/1996 | Satoh et al. | 228/127 |

FOREIGN PATENT DOCUMENTS

| | | |
|---|---|---|
| 55-49939 | 12/1980 | Japan . |
| 61-291979 | 12/1986 | Japan . |
| 4-329896 | 11/1992 | Japan . |

OTHER PUBLICATIONS

A. Talaat el–Mallah et al., "Autocatalytic (Electroless) Deposition on Nickel–Phosphorus–Boron Alloys: Part III. Deposit Properties", Metal Finishing, Aug. 1993, pp. 23–28.

C.K. Mital et al., "Electroless Nickel–Phosphorus–Boron Alloy Coatings", Metal Finishing, Oct. 1986, pp. 67–70.

*Primary Examiner*—John J. Zimmerman

*Attorney, Agent, or Firm*—Burns, Doane, Swecker & Mathis, L.L.P.

[57] ABSTRACT

Disclosed are electrolessly plated nickel coatings containing 0.5 to 3.0% by weight of phosphorus and 0.05 to 2.0% by weight of boron, coatings obtained by subjecting to heat treatment electrolessly plated nickel coatings containing 0.5 to 3.0% by weight of phosphorus and 0.05 to 2.0% by weight of boron and machine parts having sliding surfaces wherein at least the sliding surfaces are coated with the coatings. The coatings can be suitably provided on base materials composed of aluminum alloys or the like, show high hardness, high impact strength (high toughness) and improved lubricating characteristics such as sliding characteristics and, in addition, can be formed at a high rate.

20 Claims, 6 Drawing Sheets

ELECTROLESSLY PLATED NICKEL/PHOSPHORUS/BORON SYSTEM COATINGS AND MACHINE PARTS UTILIZING THE COATINGS

BACKGROUND OF THE INVENTION

1. Field of the Invention

The present invention relates to electrolessly plated nickel coatings and machine parts utilizing the coatings. More precisely, it relates to plated coatings showing high impact strength, high hardness and improved lubricating characteristics such as sliding characteristics (friction coefficient, wear resistance, anti-seizure property).

2. Related Art

Electroless plating is more advantageous than electrolytic plating in terms of the fact that it enables to easily produce uniform plated coatings only by immersing articles to be plated into plating baths. Electrolessly plated coatings composed of nickel added with phosphorous and/or boron have been utilized as surface treatments of various machine parts and the like since they shows relatively high hardness (Japanese Patent Un-examined Publication (A-1 publication) Nos. 51-109224 (109224/76) and 61-291979 (291979/86)). Such coatings further containing microparticles of nitrides, carbides or the like have also been known (Japanese Patent Un-examined Publication No. 4-329896 (329896/92)).

Electrolessly plated coatings composed of nickel and phosphorus (Ni—P) may be advantageously produced at a high rate since plating baths for such coatings are generally stable. In order to obtain such coatings with high hardness, heat treatments at a high temperature, i.e., more than 280° C., are required. However, such heat treatments at a high temperature may reduce hardness of base materials composed of, for example, precipitation hardening type aluminum alloys and simultaneously reduce toughness of the coatings themselves and hence their impact strength may be also reduced.

Electrolessly plated coatings composed of nickel and boron (Ni—B) have a problem that it is difficult to deposit such coatings at a high rate since plating baths for such coatings are unstable. On the other hand, these coatings have an advantage that they can have relatively high hardness (HV 650 to 750) with heat treatments at a temperature around 200° C. However, to obtain a higher hardness exceeding HV 800, they requires heat treatments at a further higher temperature and, in such a case, they may show the same problem as the Ni—P coatings.

Electrolessly plated coatings composed of nickel, phosphorus and boron (Ni—P—B) having the following compositions have also been known:

① P: 6.8 to 7.8% by weight, B: 0.7 to 0.3% by weight,

② P: 1.4 to 6.6% by weight, B: 2.1 to 7.1% by weight, and

③ P: 0.3 to 0.5% by weight, B: 4.7 to 9.8% by weight.

Coatings having a composition of ① have a high phosphorus content and show their properties similar to those of the Ni—P coatings and they cannot acquire sufficient hardness by heat treatment at a low temperature. Coatings having a composition of ② are formed by deposition from acidic baths containing $NaBH_4$. Such baths are very likely to decompose and cannot be used in practical applications. In addition, experimentally produced coatings having such a composition have shown a hardness of only HV 672 at most. Coatings having a composition of ③ are formed by deposition from alkaline baths containing $NaBH_4$. Since such baths are highly alkaline, they may corrode base materials composed of aluminum alloys or the like and they cannot be formed on the base materials without protective layers. If such protective layers are provided, they constitute intermediate layers between the plated coatings and the base materials, but existence of such intermediate layers may disadvantageously reduce their hardness.

Therefore, an object of the present invention is to provide electrolessly plated coatings which can be suitably provided on base materials composed of aluminum alloys or the like, show high hardness, high impact strength (high toughness) and improved lubricating characteristics such as sliding characteristics and, in addition, can be formed at a high rate.

Another object of the present invention is to provide sliding machine parts of which sliding surfaces are covered by the plated coatings described above and show high impact strength (high toughness), high hardness and improved lubricating characteristics such as sliding characteristics.

SUMMARY OF THE INVENTION

The present invention provides electrolessly plated nickel coatings containing 0.5 to 3.0% by weight of phosphorus and 0.05 to 2.0% by weight of boron.

The present invention further provides machine parts having sliding surfaces wherein at least the sliding surfaces are covered with the above-described plated coatings of the present invention.

DESCRIPTION OF THE PREFERRED EMBODIMENTS

Figure 1:
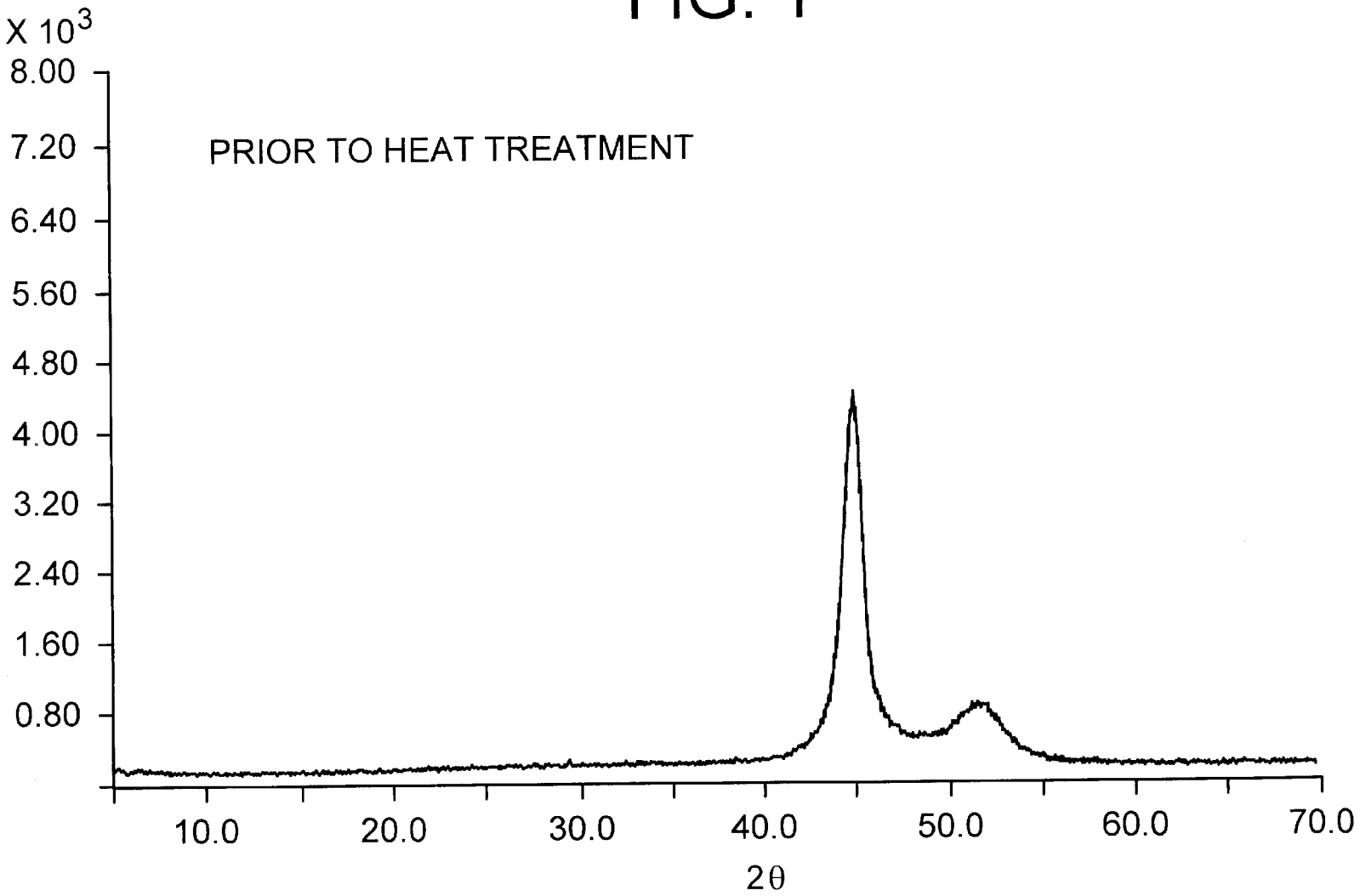
FIG. 1 is an X-ray diffraction pattern of a plated coating of the present invention (before heat treatment).
Figure 2:
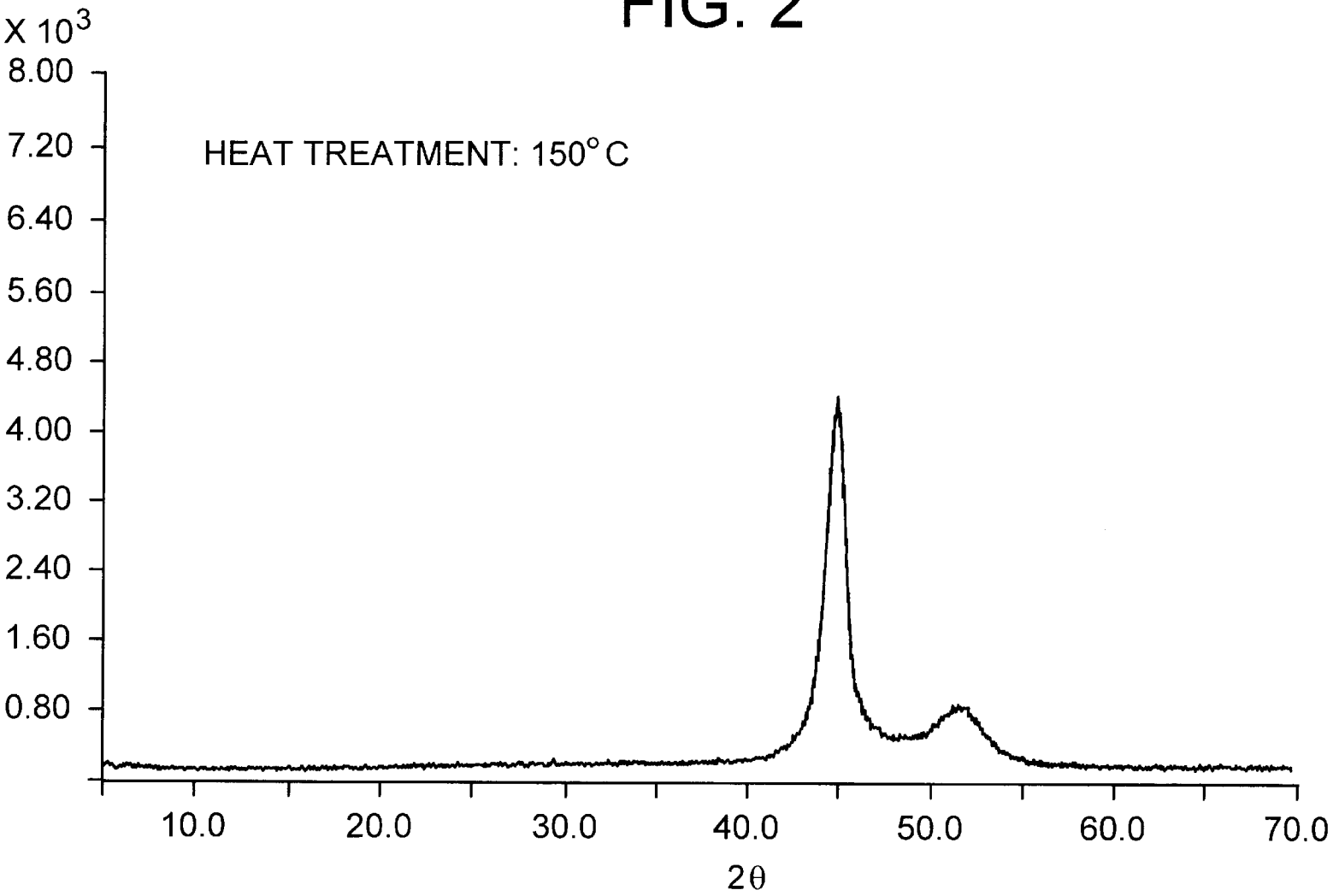
FIG. 2 is an X-ray diffraction pattern of a plated coating of the present invention (after heat treatment at 150° C.).
Figure 3:
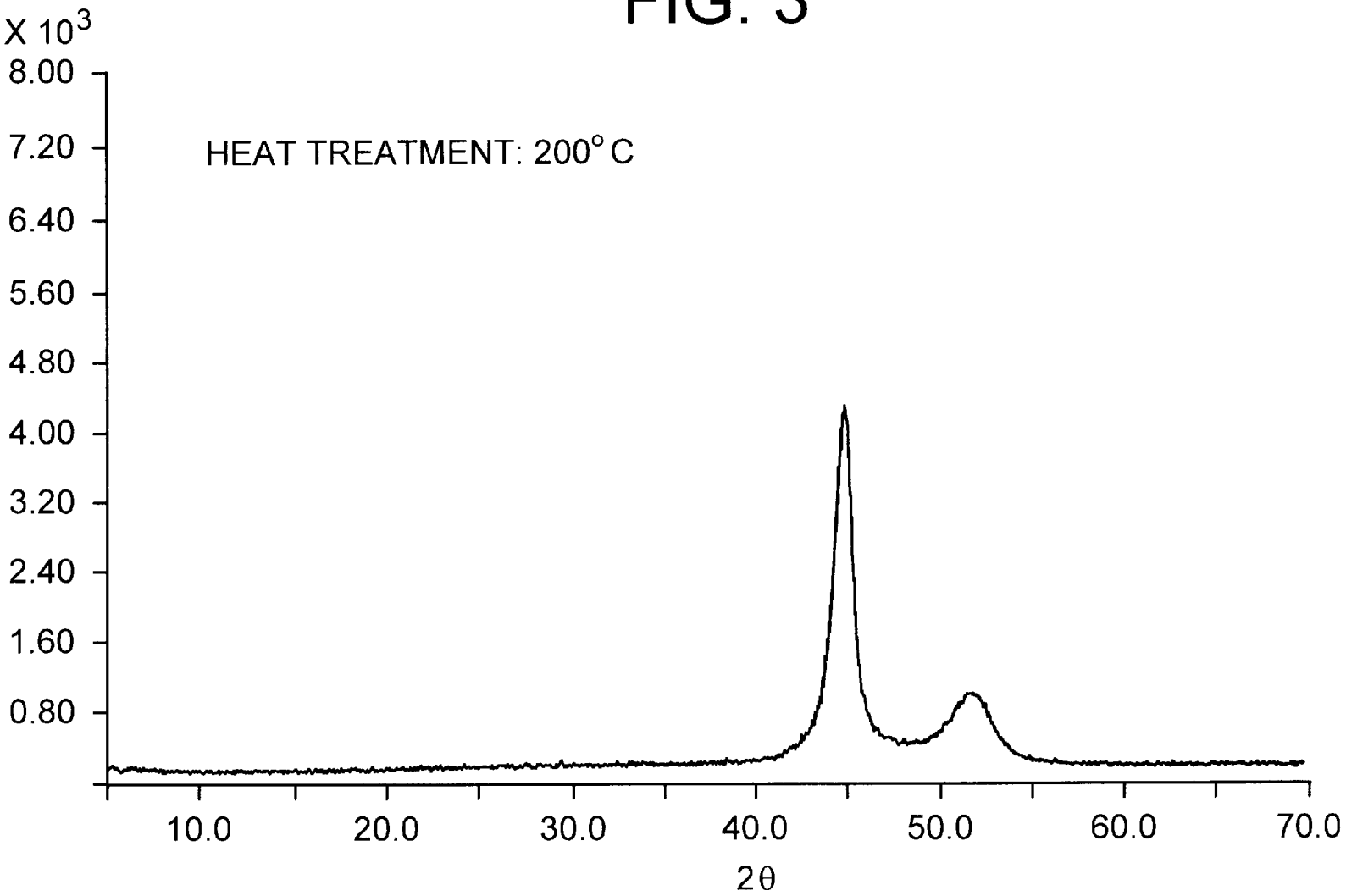
FIG. 3 is an X-ray diffraction pattern of a plated coating of the present invention (after heat treatment at 200° C ).
Figure 4:
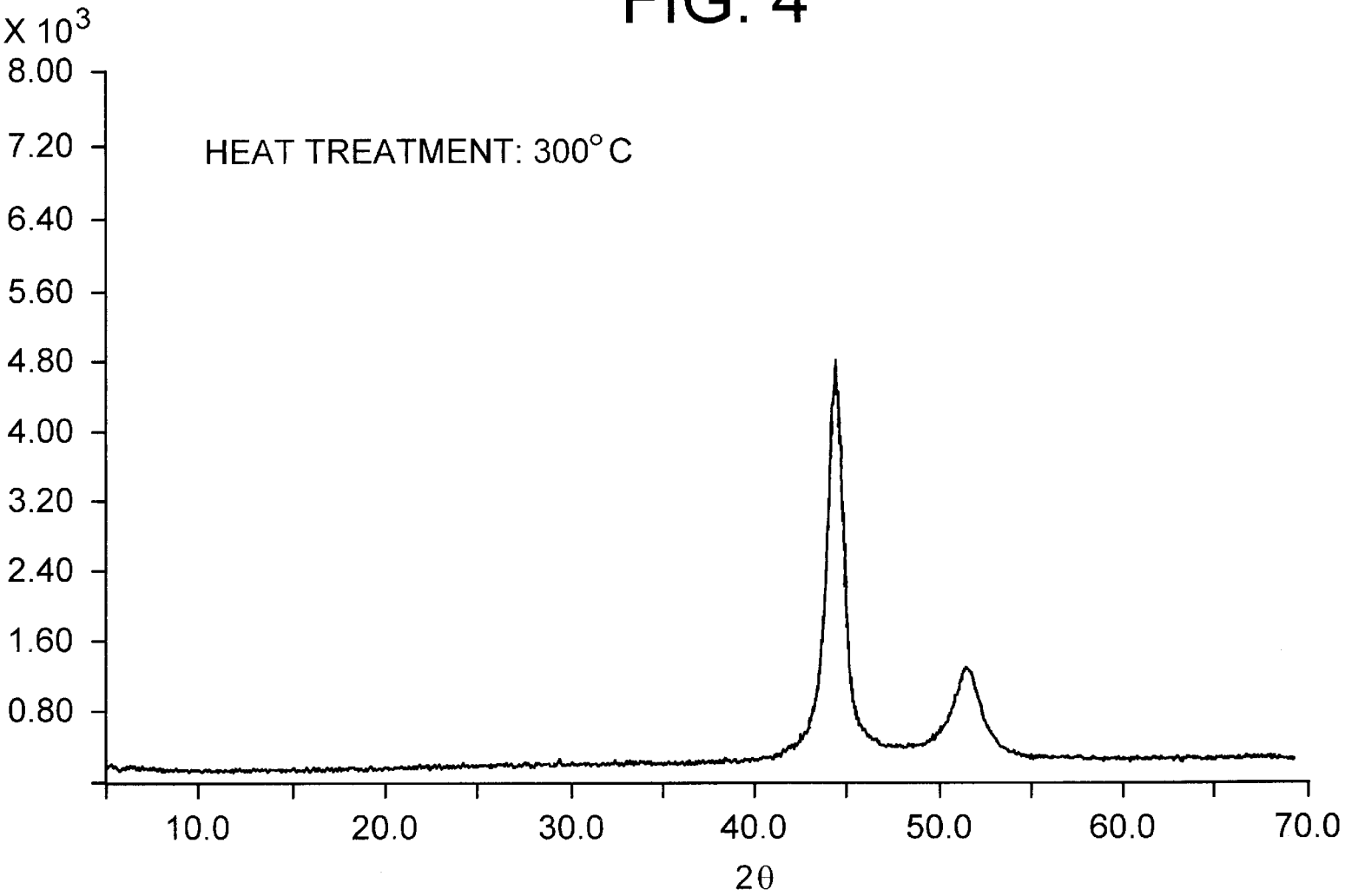
FIG. 4 is an X-ray diffraction pattern of a plated coating of the present invention (after heat treatment at 300° C.).
Figure 5:
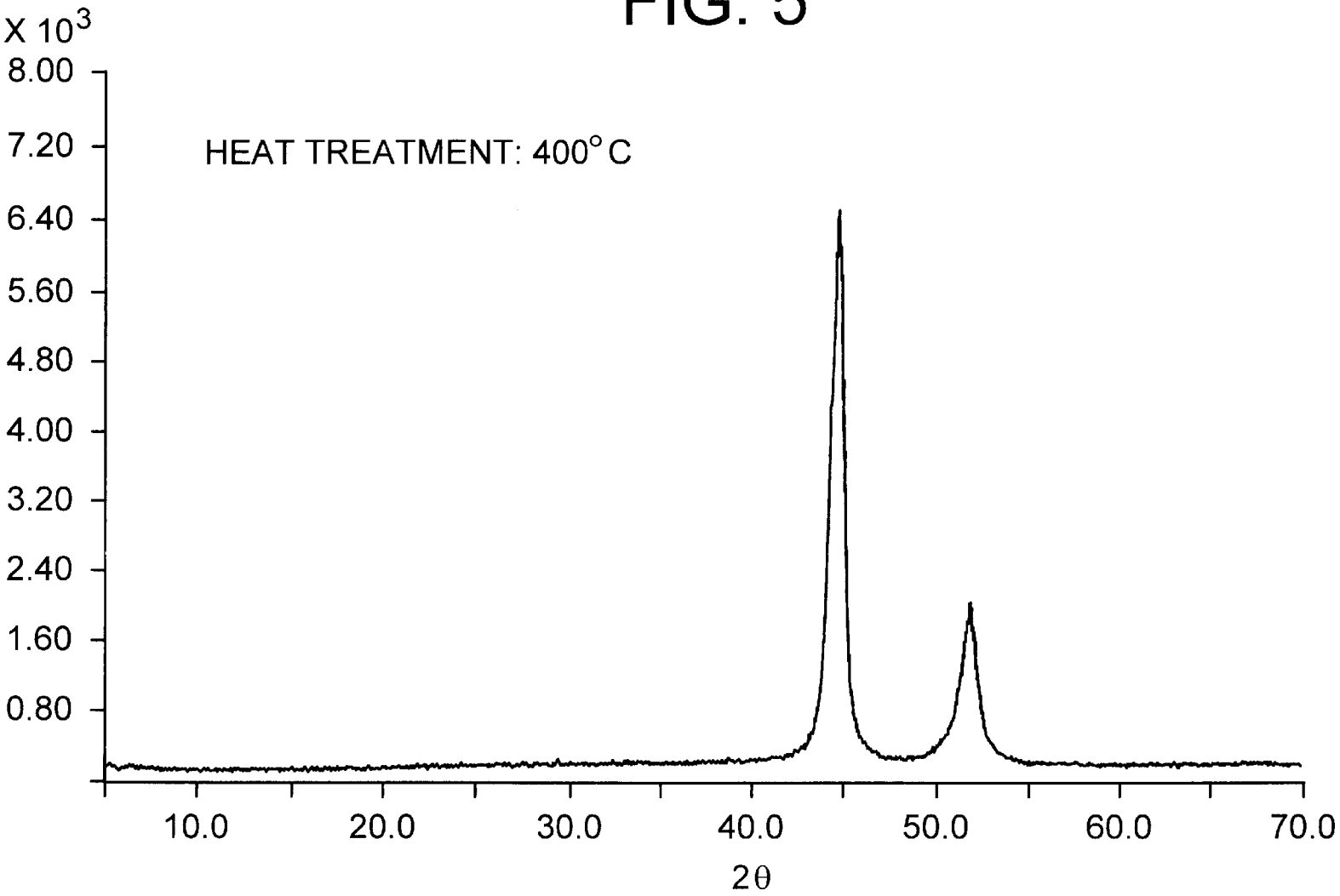
FIG. 5 is an X-ray diffraction pattern of a plated coating of the present invention (after heat treatment at 400° C. ).

The present invention will be further explained in detail hereinafter.

The electrolessly plated nickel coatings of the present invention comprise 0.5 to 3.0% by weight of phosphorus and 0.05 to 2.0% by weight of boron and they preferably comprise 1.0 to 2.0% by weight of phosphorus and 0.05 to 1.0% by weight of boron. Nickel coatings having a phosphorus content less than 0.5% by weight cannot be formed with plating baths containing hypophosphites or the like as a reducing agent. In addition, such plating baths are unstable and show lower plating rates. When the phosphorus content exceeds 3.0% by weight, the plated coatings become amorphous and high hardness cannot be obtained without heat treatments at a temperature higher than 280° C.

When the boron content in the electrolessly plated nickel coatings is less than 0.05% by weight, hardness of deposited coatings is unacceptably low and high hardness cannot be obtained even after heat treatments. When the boron content exceeds 2.0% by weight, hardness equal to or more than HV 800 cannot be obtained unless heat treatment are performed at a temperature higher than 250° C.

The above-described plated coatings of the present invention may be deposited and formed from electroless plating baths containing nickel salts, and phosphorus compounds and boron compounds as reducing agents. Examples of the nickel salts are nickel chloride, nickel sulfate, nickel acetate, nickel carbonate and the like. Examples of the phosphorus compounds used as reducing agents are sodium hypophosphite, potassium hypophosphite, nickel hypophosphite and the like. Examples of the boron compounds used as reducing agents are dimethylamine borane, diethylamine borane, sodium borohydride and the like. Ratios of the nickel salts, the phosphorus compounds and the boron compounds in plating baths may be suitably selected depending on the compositions of the plating coatings. Concentrations of these components may be decided in view of bath stability, deposition rate and the like, and suitable concentrations of the nickel salts are normally selected within a range of from 15 g/liter to 30 g/liter.

The plating baths may contain organic acids such as acetic acid, malic acid and citric acid and chelating agents such as ethylenediaminetetraacetic acid to obtain suitable stability, pH buffering effect and the like. To prevent deposition of the nickel compounds due to their self-docomposition, the plating baths may contain a small amount of lead nitrate, bismuth nitrate, antimony salts, sulfur compounds and the like as stabilizers. Further, pH of the plating baths described above is adjusted within a range of from 6 to 7 in view of bath stability, deposition rate and the like.

The plated coating of the present invention may be formed by immersing surfaces of base materials to be plated into the plating baths described above for a certain period of time. While plating bath temperature may be selected by considering bath stability, deposition rate and the like, it is selected within a range of, for example, from 60 to 95° C., preferably from 70 to 90° C. By selecting immersing period, thickness of the coatings may be desirably varied. The plated coatings of the present invention preferably have a thickness of from 2 to 50 $\mu$m, preferably from 5 to 30 $\mu$m, when coating hardness and toughness as well as sliding characteristics are considered.

Before the immersion into the plating baths, surfaces of base materials to be plated are preferably subjected to pre-treatments, which may be those performed in conventional plating processes, in order to improve adhesion between the surfaces and plated coatings. Such pre-treatments include, for example, degreasing with solvents or alkaline solutions, zincate process and immersion in acids.

Plated nickel coatings containing desired amounts of phosphorus and boron can be obtained by the electroless plating described above. Coating hardness of the nickel plated coatings obtained above may be improved by subjecting them to heat treatments. Conditions for the heat treatments may be selected in view of hardness required for the coatings and heat resistance of the base materials. Such heat treatments can be performed at a temperature within a range of, for example, from 150 to 400° C. When the temperature is below 150° C., improvements of coating hardness and adhesion would be insufficient. On the other hand, the temperature exceeds 400° C., coating hardness would be deteriorated. A preferred temperature range is from 200 to 350° C. Further, period for heat treatments may be decided in view of treating temperature, hardness required for the coatings, heat resistance of the base materials, productivity and the like, and a suitable period is normally 30 to 120 minutes.

The heat treatments may be performed in an atmosphere of, for example, air, inert gases, reducing gases or the like and it may be suitably selected considering operability, cost and the like. During the heat treatments described above, crystals gradually grow in the plated coatings and they get harder. Because the plated coatings having the compositions described above have lower crystallinity after plating, they may be crystallized by heat treatments at a relatively lower temperature compared with conventional plated nickel coatings and therefore coatings having higher hardness can be obtained.

Base materials to be plated according to the present invention are not particularly limited. They may be any articles which can utilize the characteristics of the plated coatings of the present invention and they may be, but not limited to, machine parts composed of iron alloys or aluminum alloys. Examples of the iron alloys are high speed tool steel and bearing steel. Examples of the aluminum alloys are aluminum alloys of 2000, 4000, 5000, 6000 and 7000 types and high silicon content aluminum alloys including 380, 383, 384 and 390 types. The plated coatings are particularly suitably applied to parts composed of precipitation hardening type aluminum alloys, since the coatings according to the present invention can be formed with high hardness by heat treatments at a relatively low temperature.

According to the present invention, in particular, there can be provided sliding machine parts at least of which sliding surfaces are coated with the plated coatings described above. The machine parts are not particularly limited so long as they have sliding surfaces. Their examples include sliding parts of compressors, fuel injection pumps and the like. The coatings of the present invention are particularly useful as surface finishing materials of sliding parts of compressors for air conditioners.

The plated coatings of the present invention exhibit advantages that they have high impact strength (high toughness), high hardness and good sliding characteristics and they can be uniformly formed at a high rate. In particular, after plating, high hardness equal to or more than HV 800 can be obtained by heat treatments at a temperature around or lower than aging temperatures after solution heat treatments of precipitation hardening type aluminum alloys (200° C.) without lowering hardness of base materials.

Further, since the coatings of the present invention have high hardness, they are excellent in frictional resistance against silicon primary crystal particles contained in high silicon content aluminum alloys. Moreover, they show good sliding characteristics even in poor lubricity fluids and hence they show good sliding characteristics with aluminum alloys in environments where HFC134a exists and problematically lowers lubricity. That is, they show small friction with partner parts, little wear (also little wear of partner parts) and high seizing limit.

Furthermore, as advantages in their production, they can produce at a high deposition rate of more than 25 $\mu$m/hour and plating baths therefor are stable.

Thus, according to the present invention, there can be provided machine parts having surfaces of high impact strength (high toughness), high hardness and excellent lubricating characteristics such as sliding characteristics.

EXAMPLES

The present invention will be further explained hereinafter by referring to the following working examples.

Example 1

Plating of Ni—P-B coatings

Used was an electroless plating bath prepared by diluting S-790 (trade mark: Nippon Kanizen, Tokyo, Japan, nickel-phosphorus electroless plating bath containing sodium hypophosphite) solution 5 times with pure water and adding a small amount of stabilizer and then a suitable amount of dimethylamine borane. After adjusting pH of this plating bath to 6.2 with sodium hydroxide, the bath was warmed to 80 to 82° C. A vane (42×17×4 mm) composed of high silicon content aluminum material was introduced into the bath. Prior to the immersion, the vane had been subjected to the following pre-treatments:

① decreasing: 5 minutes with solvent (immersion into methylene chloride and washing with steam), ② mild alkali degreasing at 40° C. for 1 minutes (20 g/liter of sodium carbonate and 20 g/liter of sodium tripolyphosphate in water), ③ washing with water, ④ etching at 20 to 25° C. for 30 seconds (9 parts of nitric acid [67.5%], 2 parts of hydrofluoric acid [50%] and 1 part of water), ⑤ washing with water, ⑥ zincate treatment at 20 to 25° C. for 30 seconds (120 g/liter of sodium hydroxide, 20 g/liter of zinc oxide, 2 g/liter of ferric chloride, 50 g/liter of Rochell salt and 1 g/liter of ammonium nitrate), ⑦ immersion into acid (10% nitric acid) at 20 to 25° C. for 1 minute, ⑧ washing with water, and ⑨ zinc immersion treatment (similar to ⑥ above).

After subjected to the steps of ① to ⑨ described above in turn, the vane was washed with water and electrolessly plated.

The vane was immersed in the electroless plating bath described above for about 40 minutes and then washed with water. Thickness of the resulted plated coating was 16 μm. Then, the plated vane was subjected to heat treatment in an electric furnace (in air) at 200° C. for 1 hour.

Composition of the plated coating was analyzed by using a plated coating formed on a piece of SUS304 (15×10×3 mm) which had been immersed in the bath simultaneously with the vane. Analysis was carried out by the dimethylglyoxime-EDTA titration method for Ni and inductively coupled plasma (IPC) method for P and B. As a result, its composition of Ni: 98.2% by weight, P: 1.67% by weight and B: 0.13% by weight was obtained.

Figure 6:
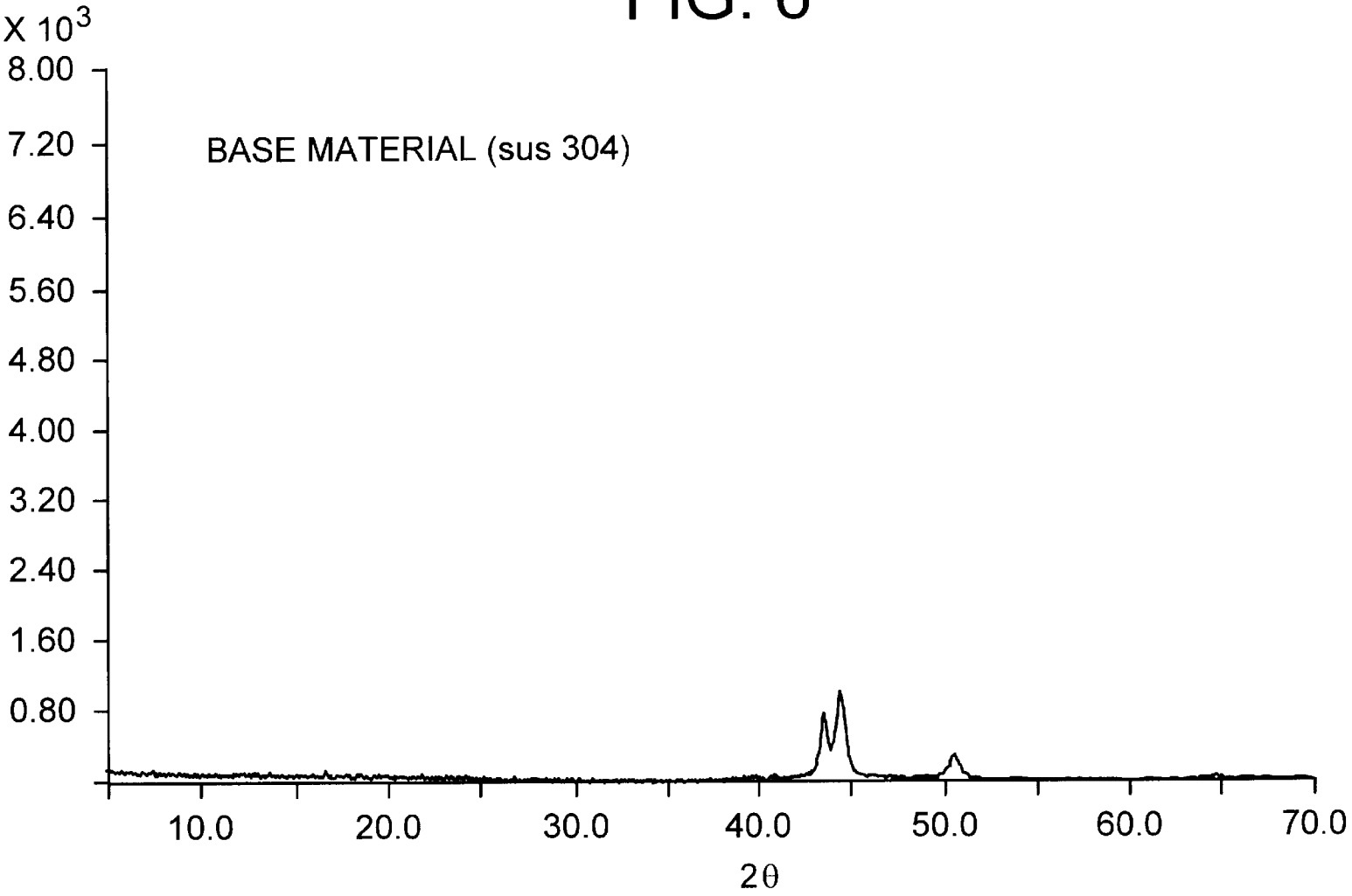
FIG. 6 is an X-ray diffraction pattern of a base material.

Further, crystalline phase of the plated coating was identified by X-ray diffraction (XRD) analysis. An X-ray diffraction pattern before the heat treatment is shown in FIG. 1. X-ray diffraction patterns after heat treatments at 150° C., 200° C., 300° C. and 400° C. (1 hour for each case) are shown in FIGS. 2 to 5, respectively. An X-ray diffraction pattern of the base material, SUS304, is shown in FIG. 6. As seen from the figures, the X-ray patterns of FIGS. 1 to 5 are similar to one another. That is, all of the patterns showed only two broad diffraction peaks representing nickel. Therefore, from the results of the X-ray diffraction analysis, it can be considered that phase constituting the deposited Ni—P—B was Ni having relatively low crystallinity for each case.

Comparative Example 1

Ni—P8%, Heat Treatment at 200° C. for 1 hour

An electroless plating bath prepared by diluting SK-100 (trade mark: Nippon Kanizen, Tokyo, Japan, nickel-phosphorus electroless plating bath containing sodium hypophosphite, pH 4.5) solution 5 times with pure water was used. After adjusting pH of this plating bath to 4.5, the bath was warmed to 90° C. A vane (42×17×4 mm) composed of the same high silicon content aluminum material as used in Example 1 was subjected to the same pre-treatments as Example 1 and introduced into the bath. The vane was immersed into the bath for about 1 hour to plate a coating having a thickness of 16 μm, washed with water and subjected to heat treatment in an electric furnace (in air) at 200° C. for 1 hour.

Comparative Example 2

Ni—P8%, Heat Treatment at 320° C. for 1 hour

A coating was plated in a manner similar to that of Comparative Example 1 and subjected to heat treatment at 320° C. for 1 hour.

Comparative Example 3

Ni—P2%, Heat Treatment at 200° C. for 1 hour An electroless plating bath prepared by diluting S-790 (trade mark: Nippon Kanizen, Tokyo, Japan, nickel-phosphorus electroless plating bath containing sodium hypophosphite) solution 5 times with pure water was used. After adjusting pH of this plating bath to 5.8, the bath was warmed to 90° C. A vane (42×17×4 mm) composed of the same high silicon content aluminum material as used in Example 1 was subjected to the same pre-treatments as Example 1 and introduced into the bath. The vane was immersed in the bath for about 1 hour to plate a coating having a thickness of 16 μm, washed with water and subjected to heat treatment in an electric furnace (in air) at 200° C. for 1 hour.

Comparative Example 4

Ni—P2%, Heat Treatment at 250° C. for 1 hour

A coating was plated in a manner similar to that of Comparative Example 3 and subjected to heat treatment at 250° C. for 1 hour.

Comparative Example 5

Ni—B0.5%, Heat Treatment at 200° C. for 1 hour

An electroless plating bath prepared by diluting SB-55 (trade mark: Nippon Kanizen, Tokyo, Japan, nickel-boron electroless plating bath containing dimethylamine borane) solution 5 times with pure water was used. After adjusting pH of this plating bath to 6.0, the bath was warmed to 60° C. A vane (42×17×4 mm) composed of the same high silicon content aluminum material as used in Example 1 was subjected to the same pre-treatments as Example 1 and introduced into the bath. The vane was immersed into the bath for about 1 hour to plate a coating having a thickness of 16 μm, washed with water and subjected to heat treatment in an electric furnace (in air) at 200° C. for 1 hour.

Comparative Example 6

Ni—0.5%, Heat Treatment at 320° C. for 1 hour

A coating was plated in a manner similar to that of Comparative Example 5 and subjected to heat treatment at 320° C. for 1

Test Example 1

Hardness of Coatings

With respect to the coatings obtained in Example 1 and Comparative Examples 1 to 6, hardness was determined by a Vickers' microhardness tester (test load: 25 gf). Results are shown in Table 1.

TABLE 1

| | Plated coating | Heat treatment ° C.-hour | Coating hardness HV | Coating hardness Evaluation | Base material hardness HBR | Base material hardness Evaluation |
|---|---|---|---|---|---|---|
| Example 1 | Ni—P—B | 200-1 | 880 | Good | 94 | Good |
| Comparative Example 1 | Ni—P 8% | 200-1 | 560 | Bad | 94 | Good |
| Comparative Example 2 | Ni—P 8% | 320-2 | 930 | Good | 85 | Bad |
| Comparative Example 3 | Ni—P 2% | 200-1 | 760 | Fair | 94 | Good |
| Comparative Example 4 | Ni—P 2% | 250-1 | 820 | Good | 89 | Fair |
| Comparative Example 5 | Ni—B 0.5% | 200-1 | 750 | Fair | 94 | Good |
| Comparative Example 6 | Ni—B 0.5% | 320-2 | 1200 | Good | 85 | Bad |

From the results shown in Table 1, it can be seen that the plated coating of the present invention could have an HV hardness exceeding 800 by the heat treatment at 200° C. for 1 hour of which conditions do not affect hardness of the base material. In contrast, it can be seen that the coatings of Comparative Examples 1 to 6 required heat treatments under conditions which may affect hardness of the coatings in order to obtain an HV hardness exceeding 800, or an HV hardness exceeding 800 cannot be obtained by a heat treatment under conditions which do not affect hardness of the base material.

Test Example 2

Toughness (Scratch Test)

A diamond cone was pressed on each of the samples of Example 1, Comparative Examples 1 to 3, 5 and 6 and swept with continuously increasing the load to detect acoustic emission (AE) generated by failure of the coatings. Further, after the sweeping, crack initiation load was determined from a position where crack appeared. Coatings showing high crack initiation load and no or little AE are considered excellent coatings. Results are shown in Table 2.

TABLE 2

| | Plated coating | Heat treatment ° C.-hour | Crack initiation load (N) | AE generation | Evaluation |
|---|---|---|---|---|---|
| Example 1 | Ni—P—B | 200-1 | 30 | Absent | Good |
| Comparative Example 1 | Ni—P 8% | 200-1 | >50 | Absent | Good |
| Comparative Example 2 | Ni—P 8% | 320-2 | 5 | Present | Bad |
| Comparative Example 3 | Ni—P 2% | 200-1 | 50 | Absent | Good |
| Comparative Example 5 | Ni—B 0.5% | 200-1 | 30 | Absent | Good |
| Comparative Example 6 | Ni—B 0.5% | 320-2 | 5 | Present | Bad |

Test Example 3

Sliding characteristics

With respect to the samples of Example 1, Comparative Examples 2 to 4 and 6, frictional wear test was performed with a mind to one of the major uses of the plated coatings according to the present invention, the use in sliding parts of light weight compressors all of which main parts are composed of aluminum.

Thrust sliding mode test of cylindrical end surface Rotating test piece: samples of Example 1 or Comparative Examples obtained by plating various coatings on high Si content aluminum alloy base materials and then subjecting to heat treatments as described above.

Fixed test piece: high Si content aluminum alloy base material.

Test environment: immersed in a liquid comprising PAG type lubricant with an alternative refrigerant, non-chlorine type fluorocarbon HFC134a, in a pressure vessel of 3 MPa withstanding pressure.

Test method

① Friction test:

Surface pressure is increased stepwise and variation of friction coefficient and seizure pressure are determined.

② Wear test:

Worn amount after 3 hours under a constant surface pressure (15 MPa) is determined.

Results are shown in Table 3.

TABLE 3

| | Plated coating | Heat treatment (° C.-hour) | Friction coefficient (–) | Seizure pressure (MPa) | Worn amount (mg) Plated coating | Worn amount (mg) Partner part | Evaluation |
|---|---|---|---|---|---|---|---|
| Example 1 | Ni—P—B | 200-1 | 0.05–0.09 | >40 | <0.1 | <0.1 | Good |
| Comparative Example 2 | Ni—P 8% | 320-2 | 0.12–0.08 | 17 | 0.3 | 0.7 | Bad |
| Comparative Example 3 | Ni—P 2% | 200-1 | 0.09–0.11 | 15 | 2.4 | 0.1 | Bad |
| Comparative Example 4 | Ni—P 2% | 250-1 | 0.09–0.11 | 17 | 0.5 | <0.1 | Bad |
| Comparative Example 6 | Ni—B 0.5% | 320-2 | 0.05–0.08 | >40 | 1.9 | 1.4 | Fair |

Test Example 4

Durability test in real machine

With respect to samples of Example 1 and Comparative Examples 1 to 6, high speed and high load continuous operation durability test was carried out in a compressor for air conditioners. Results are shown in Table 4.

TABLE 4

| | Plated coating | Heat treatment (° C.-hour) | Result | Evaluation |
|---|---|---|---|---|
| Example 1 | Ni—P—B | 200-1 | Aimed test period was completed without trouble. | Good |
| Comparative Example 1 | Ni—P 8% | 200-1 | Severe wear was observed before aimed test period was completed. Test was suspended. | Bad |
| Comparative Example 2 | Ni—P 8% | 320-2 | Severe exfoliation was observed before aimed test period was completed. Test was suspended. | Bad |
| Comparative Example 3 | Ni—P 2% | 200-1 | Severe wear was observed before aimed test period was completed. Test was suspended. | Bad |
| Comparative Example 4 | Ni—P 2% | 250-1 | Severe wear was observed before aimed test period was completed. Test was suspended. | Bad |
| Comparative Example 5 | Ni—B 0.5% | 200-1 | Severe wear was observed when aimed test period was completed. | Fair |
| Comparative Example 6 | Ni–B 0.5% | 320-2 | Exfoliation was observed when aimed test period was completed. | Fair |

What is claimed is:

1. A coating obtained by subjecting to heat treatment an electrolessly plated nickel coating containing 0.5 to 3.0% by weight of phosphorus and 0.05 to 2.0% by weight of boron, wherein the heat treatment is effected under conditions such that the electrolessly plated nickel coating does not melt and the resulting coating exhibits an HV hardness of 800 or more.

2. The coating of claim 1 wherein the heat treatment is effected at a temperature of from 150 to 400° C. for a time period sufficient to convert the electrolessly plated nickel coating to the coating exhibiting an HV hardness of 800 or more.

3. The coating of claim 2 wherein the heat treatment is effected at a temperature of from 200 to 350° C.

4. The coating of claim 2 wherein the time period for the heat treatment is in the range of 30 to 120 minutes.

5. The coating of claim 3 wherein the time period for the heat treatment is in the range of 30 to 120 minutes.

6. The coating of claim 1 wherein the electrolessly plated nickel coating contains 0.05 to 1.0% by weight of boron.

7. The coating of claim 6 wherein the heat treatment is effected at a temperature of from 150 to 400° C. for a time period sufficient to convert the electrolessly plated nickel coating to the coating exhibiting HV 800 or more.

8. The coating of claim 6 wherein the heat treatment is effected at a temperature of from 200 to 350° C.

9. The coating of claim 7 wherein the time period for the heat treatment is in the range of 30 to 120 minutes.

10. The coating of claims 8 wherein the time period for the heat treatment is in the range of 30 to 120 minutes.

11. The coating of claim 1 wherein the electrolessly plated nickel coating contains 1.0% by weight or more of phosphorus.

12. The coating of claim 1 wherein the electrolessly plated nickel coating contains 1.0 to 2.0% by weight of phosphorus.

13. A part for a compressor or a fuel injection pump wherein at least a sliding surface of the part is coated with the coating of claim 1.

14. A part for a compressor or a fuel injection pump wherein at least a sliding surface of the part is coated with the coating of claim 2.

15. A part for a compressor or a fuel injection pump wherein at least a sliding surface of the part is coated with the coating of claim 6.

16. A part for a compressor or a fuel injection pump wherein at least a sliding surface of the part is coated with the coating of claim 11.

17. The part of claim 13, which is composed of an aluminum alloy.

18. The part of claim 14, which is composed of an aluminum alloy.

19. The part of claim 15, which is composed of an aluminum alloy.

20. The part of claim 16, which is composed of an aluminum alloy.

* * * * *